US005341726A

United States Patent [19]

Watson

[11] Patent Number: 5,341,726

[45] Date of Patent: Aug. 30, 1994

[54] PISTON FOR TANK

[76] Inventor: M. Burnell Watson, Box 34, Dorsey, Ill. 62021

[21] Appl. No.: 40,525

[22] Filed: Mar. 31, 1993

[51] Int. Cl.[5] ..... F15B 21/04

[52] U.S. Cl. ..... 92/80; 92/82; 92/112; 92/182; 277/34; 222/386; 222/389

[58] Field of Search ..... 92/80, 82, 181, 182, 92/112; 277/34, 34.3, 34.6; 222/389, 386

[56] References Cited

U.S. PATENT DOCUMENTS

| | | | |
|---|---|---|---|
| 1,892,519 | 12/1932 | Schottgen . | |
| 2,559,564 | 7/1951 | Sperling | 220/46 |
| 3,043,340 | 7/1962 | Rehbock | 138/31 |
| 3,113,705 | 12/1963 | Weitzel | 222/389 |
| 3,178,779 | 4/1965 | Clark et al. | 277/34 |
| 3,203,674 | 8/1965 | Watson | 259/3 |
| 3,321,110 | 5/1967 | Price | 222/389 |
| 3,690,742 | 9/1972 | Sung | 308/3 R |
| 3,808,816 | 5/1974 | Lucas | 60/530 |
| 3,828,988 | 8/1974 | Berry | 222/389 |
| 3,940,152 | 2/1976 | Fournier | 277/34 |
| 4,342,336 | 8/1982 | Satterthwaite et al. | 277/34 |
| 4,355,736 | 10/1982 | Schumacker et al. | 222/80 |
| 4,624,465 | 11/1986 | Rosemont | 277/34 |
| 4,632,281 | 12/1986 | Wold | 222/389 |
| 4,721,235 | 1/1988 | Watson | 222/389 |
| 4,859,121 | 8/1989 | Deysson et al. | 406/114 |
| 5,114,054 | 5/1992 | Watson | 222/389 |

FOREIGN PATENT DOCUMENTS

| | | | |
|---|---|---|---|
| 2594199 | 8/1987 | France | 277/34 |
| 0044146 | 3/1980 | Japan | 277/34 |
| 257688 | 9/1926 | United Kingdom | 277/34.3 |

*Primary Examiner*—Thomas E. Denion

*Attorney, Agent, or Firm*—Senniger, Powers, Leavitt & Roedel

[57] ABSTRACT

An elongate tank for transport or for storage in bulk of semisolid and fluid materials, such as grease and oil. The tank has an outlet at one end thereof for discharging material contained therein, and has a generally cylindric interior surface. A generally cylindric piston is sized to slide in the tank and is movable in a direction toward the outlet thereby to place material in the tank through the outlet. The piston comprises a piston member and an elastic annular seal carried in a circumferential channel around the piston member. The seal has an annular base and an annular crown disposed radially outwardly of and joined to the base with a fluid chamber between the base and crown. The seal is expandable by introducing fluid into the fluid chamber. Expansion of the seal causes the crown to be pressed radially outwardly against the interior surface of the tank so that when the piston member slides in the tank a portion of the crown is maintained in sliding engagement with the interior surface thereby to wipe the material therefrom and to seal the piston member relative to the tank. The crown has side surfaces and an outwardly facing surface. The outwardly facing surface of the crown has two sloping surface portions and a circumferential ridge intermediate the side surfaces. The ridge is defined by the junction of the surface portions.

16 Claims, 1 Drawing Sheet

PISTON FOR TANK

BACKGROUND OF THE INVENTION

This invention relates generally to a system for transporting or storing semisolid materials, such as grease or ground or comminuted food products, and liquid materials, such as oil or printers ink, in bulk quantities, and more particularly to a tank adapted for quickly and efficiently unloading semisolid or liquid material contained therein.

U.S. Pat. Nos. 4,721,235 and 5,114,054 (incorporated herein by reference) disclose a tank for bulk transport and storage of semisolid and liquid materials. The tank has a follower piston with a pneumatically expandable rubber seal at one end thereof for seating the piston relative to the tank while accommodating changes in interior cross-section of the tank and means, such as a plurality of pads fastened to the piston and extending radially outwardly therefrom, for preventing canting of the piston as it moves within the tank. The seal is positioned between two parallel flanges around the piston which extend radially outwardly from the piston for resisting axial movement of the seal relative to the piston.

When the tank is new its interior surface closely approximates a circular cylinder with little variance of the inside diameter of the hank. An exemplary tank has an inside tank diameter of approximately seventy inches and utilizes an air pressure of about 10–12 psig in the seal to properly expand the seal against the tank's interior surface. As the tank gets older, imperfections (such as out of round areas caused by sagging of the tank, or dents or "clings") may form resulting in increasingly larger variations in the inside diameter of the tank. To ensure that the entire surface of the tank is wiped, it may be necessary to increase air pressure in the seal to as much as 50 psig to accommodate these imperfections.

Although the increase in air pressure expands the seal to accommodate portions of the tank having increases in tank diameter, forces exerted by the seal on portions of the tank having reductions in Lank diameter are much greater than necessary to wipe the tank. These forces result in high frictional forces tending to cause the seal to wear and to scuff.

Also, because of the outward expansion of the seal, the high frictional forces, and the shape of the seal, axial movement of the piston relative to the tank may cause the crown of the seal to shift axially relative to the piston and be pinched between one of the flanges and the tank thereby resulting in an accelerated wear and shortened life of the seal and/or resulting in gouging of the seal by the flange.

SUMMARY OF THE INVENTION

Among the several objects of the invention may be noted the provision of an improved piston for a tank for transport and storage of a semisolid or fluid material in which the piston is movable in the tank to force the materials out an outlet of the tank; the provision of such a piston having an improved inflatable seal capable of effectively accommodating variances in the interior diameter of the tank when the seal is inflated at relatively low air pressures; the provision of such a piston in which the seal is configured for reducing the rubbing force between the seal and interior surface of the tank; the provision of such a piston in which the seal is configured to limit axial movement of the seal relative to the piston; the provision of such a piston in which the seal is configured to flex radially inwardly when the interior surface of the tank exerts a force on the crown as the piston slides in the tank; the provision of such a piston which is reliable in operation and relatively simple and inexpensive in construction; and the provision of such a piston which is relatively easy to assemble and insert into the tank.

The piston of this invention is for use in an elongate tank for transport or for storage in bulk of semisolid and fluid materials, such as grease and oil. The tank has a generally cylindric interior surface and all outlet at one end thereof for discharging material contained therein. The piston is generally cylindric and sized to slide in the tank and is movable in a direction toward the outlet to force material in the tank through the outlet. The piston comprises a piston member and a pair of circumferential flanges around the piston member extending radially outwardly from the piston member. The flanges are axially spaced apart to define a circumferential channel. An elastic expandable annular seal is disposed at least partly within and carried by the channel. The seal has an annular base and all annular crown disposed radially outwardly of and joined to the base. The base has an inwardly facing surface engageable with the piston member and an outwardly facing surface. The crown has side surfaces, an inwardly facing surface opposing the outwardly facing surface of the base and an outwardly facing surface engageable with the interior surface of the tank. The outwardly facing surface of the crown has sloping surface portions. The outwardly facing surface of the base and the inwardly facing surface of the crown define an annular fluid chamber. The seal also has a fluid inlet port for introducing fluid into and removing fluid from the fluid chamber for varying the pressure within the seal between atmospheric pressure and a pressure higher than atmospheric wherein the seal expands and presses against the interior surface of the tank with the pressure such that when tire piston member slides in the tank a portion of the crown is maintained in sliding engagement with the interior surface thereby to wipe the material therefrom and to seal the piston member relative to the tank. The outwardly facing surface of the crown has a circumferential ridge intermediate the side edges. The ridge is defined by the junction of the sloping surface portions. The piston further includes anti-canting members extending radially outwardly beyond the periphery of the piston member and spaced axially from the seal for engagement with the interior surface of the hank for holding the piston member against canting in the tank while permitting the piston member to slide freely in the tank.

These and other advantages and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
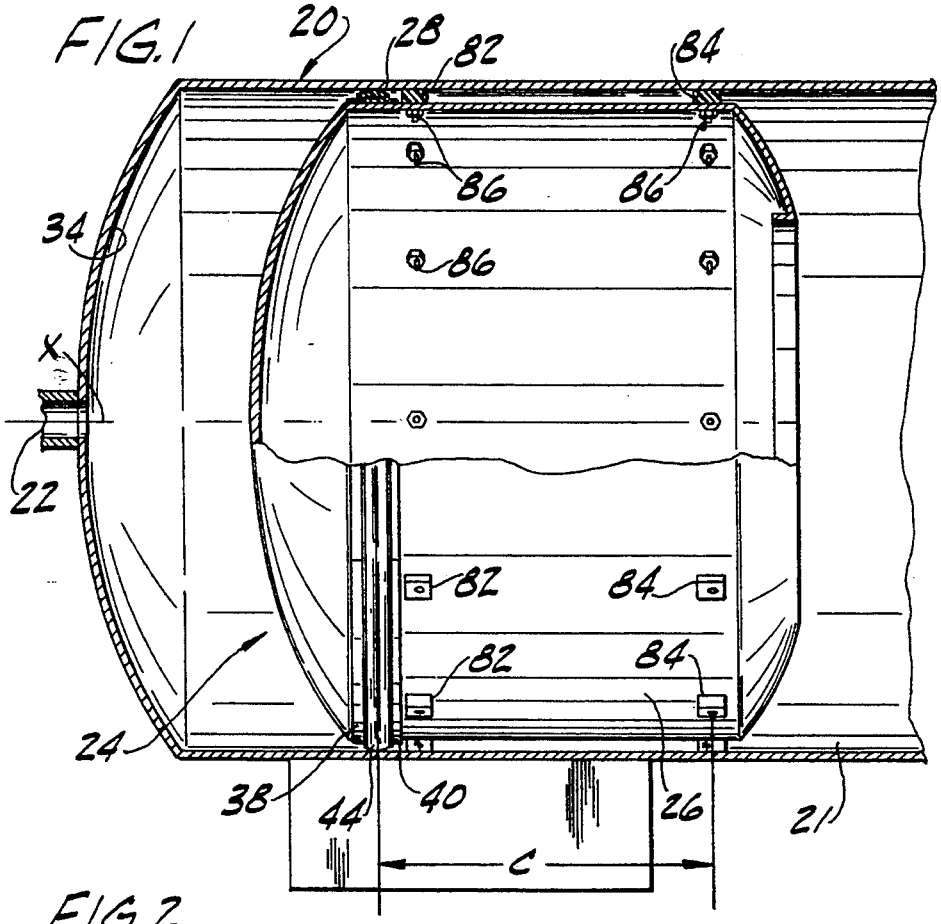
FIG. 1 is a longitudinal cross-section of an end portion of a tank of the present invention showing a piston of the present invention, partially broken away to illustrate details, movable within the tank.

Referring to the drawings, an elongate tank of the present invention is designated generally by the reference numeral 20. As shown in FIG. 1, the tank has a combination inlet and outlet port 22 at one end (hereinafter designated the forward end for convenience only) for filling and emptying tank 20 with semisolid material, such as grease or ground or comminuted food products, or fluid materials, such as oil or printers ink.

Tank 20 has a generally cylindric interior surface 21 with a generally circular cross-section throughout its length. Tank 20 may be mounted on a semitrailer (not shown) for transporting the material or may be stationary for storage of the material. A tank designed to be mounted on a semitrailer typically may have an interior diameter of approximately 68 inches and a length of 42 feet. A tank used primarily for storage may be larger or smaller and may be oriented vertically instead of horizontally. A generally cylindric piston, designated generally at 24, is dimensioned for slidable movement in tank 20 along a central axis X of tank 20. The piston 24 may be moved axially toward the forward end (left in FIG. 1) by increased air pressure on its rearward side (right in FIG. 1) to force material in the tank through port 22. Piston 24 may be moved axially rearwardly by pumping the material into port 22 or by creating a negative pressure on the rearward side of piston 24 to draw the material into the tank through port 22.

Piston 24 includes a piston member 26 and an elastic annular seal 28. The piston member 26 includes a head 30 at its forward end and a body 32 extending rearwardly of head 30. The piston member 26 may be made of metal or fabricated of synthetic resin. Preferably, the head 30 is configured for complementary engagement with an interior contour 34 of the forward end of tank 20 so that the contained material may be efficiently and completely forced through the outlet (i.e., when the piston head comes into contact with the interior contour, no substantial amount of the material is left ill the tank). For example, the head 30 of the piston member may be convex and the complementary interior contour 34 may be concave.

Piston 24 includes a circumferential channel 36 around body 32. The seal 28 is disposed at least partly within and carried by the channel 36. Channel 36 is defined between first and second circumferential flanges 38 and 40 around piston member 26 extending radially outwardly from body 32. Flanges 38 and 40 are joined to body 32 (e.g., by welding, bolts, screws, etc.) and axially spaced apart a distance W (e.g., 3½ inches) sufficient to receive seal 28.

Seal 28 is hollow and expandable and is formed of unreinforced synthetic rubber, such as VITON®, neoprene, or a Buna-N (nitrile) rubber having a hardness, for example, of approximately 65 durometer (Shore A scale). Seal 28 has an annular base 42 and an annular crown 44 disposed radially outward of the base 42. Preferably, base 42 and crown 44 have an integral one-piece construction. Base 42 has an inwardly facing surface 46 engageable with body 32 and an outwardly facing surface 48. Crown 44 has two side surfaces 49 and 51, an inwardly facing surface 50 opposing the outwardly facing surface 48 of base 42 and an outwardly facing surface 52 engageable with interior surface 21 of tank 20. Outwardly facing surface 48 of base 42 and inwardly facing surface 50 of crown 44 define an annular fluid chamber 54 (see FIG. 2) through seal 28.

Figure 2:
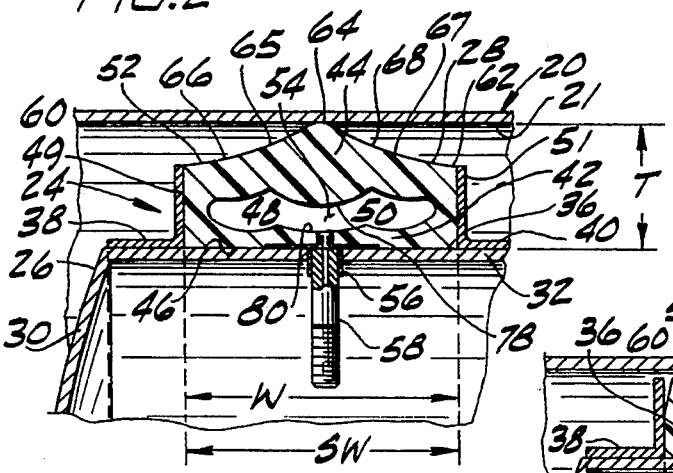
FIG. 2 is an enlarged section view of a portion of the piston of FIG. 1 showing the elastic hollow seal of the piston.
Figure 3:
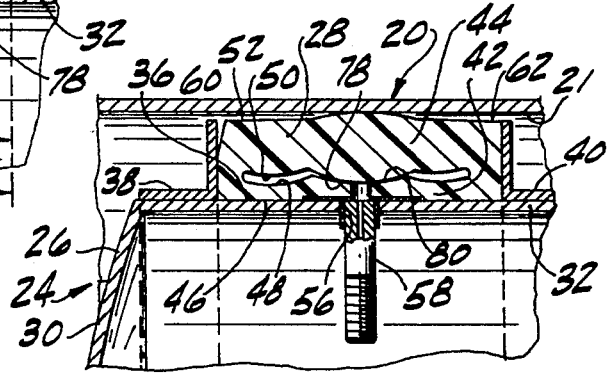
FIG. 3 is an enlarged section view of the seal of FIG. 2 flexed radially inwardly so that the crown of the seal engages the base of the seal.

As shown in FIGS. 2 and 3, seal 28 has a fluid inlet port 56 through base 42 and a valve stem 58 connected to base 42 and in fluid communication with port 56. Air or some other suitable fluid may be introduced into and removed from fluid chamber 54 via port 56 and valve stem 58 for varying the pressure within seal 28 between atmospheric pressure and a pressure higher than atmospheric (e.g., 10–12 psig). Valve stem 58 includes a normally closed valve (not shown) openable for pressurizing and depressurizing seal 28 and is accessible through the rear end of piston member 26. When pressurized, seal 28 expands and presses a portion of the outwardly facing surface 52 of crown 44 against the interior surface 21 of tank 20 so that as piston 24 slides in tank 20, crown 44 is maintained in continuous sliding engagement with interior surface 21 thereby to wipe the material therefrom and to seal piston member 26 relative to tank 20.

Preferably, the axial width SW of seal 28 is equal to the channel width W. The outwardly facing surface 52 of crown 44 has a first side edge 60 closely adjacent the outer edge of the first flange 38 and a second side edge 62 closely adjacent the outer edge of the second flange 40. Preferably, the radial distance between inwardly facing surface 46 of base 42 and the side edges 60 and 62 is equal to the height of the flanges 38 and 40. As shown in FIG. 2, outwardly facing surface 52 has two sloping surface portions 65 and 67 and a circumferential ridge (i.e., apex or peak) 64 at an axially intermediate region of the crown (preferably the center of the crown). Ridge 64 is defined by the junction of sloping surface portions 65 and 67. Surface portion 65 has a first circumferential concave region 66 axially between ridge 64 and the first side edge 60. Surface portion 67 has a second circumferential concave region 68 axially between ridge 64 and the second side edge 62. Since the concave regions 66 and 68 of crown 44 are adjacent side edges 60 and 62, seal 28 can accommodate substantial axial shifting (movement) of crown 44 relative to piston member 26 without any portion of crown 44 being pinched radially between one of the flanges 38 and 40 and the interior surface 21 of tank 20.

When, as piston 24 is moved axially forward relative to tank 20, crown 44 engages tank imperfections of the type which result in a reduced diameter of interior surface 21 (as depicted in FIG. 3), crown 44 flexes radially inward. Inward flexing of crown 44 helps minimize the rubbing force of crown 44 against interior surface 21, thereby increasing the life of seal 28.

As shown in FIGS. 2 and 3, the annular fluid chamber 54 is preferably shallow (i.e., the radial distance between the outwardly facing surface 48 of base 42 and the inwardly facing surface 50 of crown 44 is small) relative to its axial width. Because the fluid chamber 54 is shallow, the outwardly facing surface 48 of base 42 engages the inwardly facing surface 50 of crown 44 when crown 44 flexes radially inwardly. The frictional force developed between the engaging surfaces 48 and 50 resists forces (such as the rubbing force of crown 44 against interior surface 21) tending to axially move crown 44 relative to piston member 26. Preferably, the inwardly facing surface 50 of crown 44 has a circumferential convex protrusion 78 (see FIG. 3) engageable with a circumferential concave recess 80 in base 42 to further limit axial movement of crown 44 relative to piston member 26.

Preferably, the width SW of seal 28 is at least twice the thickness T (i.e., the radial distance from the inwardly facing surface 46 of base 42 and the outwardly facing surface 52 of crown 44) of seal 28. For a given inflation pressure a wide seal can radially expand a greater distance than can a narrow seal. Therefore, a wide seal can accommodate substantial variances in tank diameter without significantly varying the inflation pressure of the seal. Since high inflation pressures are not necessary for the seal to adequately accommodate variances in tank diameter without significantly reducing the wiping and sealing action of the seal, the rubbing force of crown 44 against interior surface 21 is further reduced.

An exemplary seal for a tank having an interior diameter of approximately 68 inches has an inner diameter (i.e., diameter of the inwardly facing surface 46 of base 42) of 65 inches, an uninflated thickness T of 1 9/16 inches (prior to insertion in the tank), and an axial width SW of 3½ inches. Thus, prior to insertion in the tank with the pressure in the fluid chamber 54 being at atmospheric, seal 28 has an outer diameter (i.e., ridge diameter) of 68⅛ inches—⅛ inch larger than the interior diameter of the tank. Since the outer diameter of the seal is preferably slightly larger than the tank diameter, the seal must be contracted slightly during insertion into the tank. However, because of its configuration (described above), the seal is sufficiently flexible when valve stem 58 is open to facilitate insertion of the piston 24 into the tank. Upon insertion of the piston into the tank, seal 28 is inflated or pressurized to 10–12 psig to expand it to press crown 44 against the interior surface 21 of the tank so that material is wiped from the interior surface 21 as the piston is moved axially in the tank and to seal the piston member 26 relative to the tank. Even without increasing the pressure in the fluid chamber 54 to pressures in excess of 10–12 psig, the exemplary seal 28 will accommodate imperfections in the tank which vary the tank diameter by as much as 1½ inches.

As shown in FIG. 1, anti-canting members, such as pads 82 and 84, are fastened (e.g., by bolts 86 having recessed leads) to piston body 32 and extend radially outward therefrom beyond the periphery of the piston body for engagement with the interior surface 52 of the tank to hold piston 24 against canting in tank 20. The pads are of low friction material (e.g., nylon), thereby permitting the piston member to slide freely in the tank. Canting of the piston may alternatively be prevented, for example, by a continuous or unbroken circumferential or peripheral radially extending rib.

The pads lave a thickness (radially of piston body) of somewhat less than one-half of the difference between the diameter of the piston body and tire interior diameter of the tank. For example, if the diameter of the piston body is approximately 65 inches arid the interior diameter of the tank approximately 68 inches, that the thickness of each pad is approximately 1¼ inches. Also, the pads may be approximately 3 inches long (axially of the piston body) and 1½ inches wide (circumferentially of piston body).

As shown in FIG. 1, pads 84 are spaced axially of the piston member 26 from the seal 28 a distance C sufficient to prevent canting of the piston (e.g., adjacent the rearward end of the piston body). For example, the pads may be arranged in one circumferential row (i.e. pads 84) around the periphery of the piston body, or they may be arranged in two circumferential rows (i.e. pads 82 and 84) around the periphery of the piston body wherein the second row of pads (i.e. pads 82) are generally adjacent seal 28. Each pad may be spaced within its row at approximately uniform distances from the nearest other pads (e.g., at 30 degree intervals around the circumference of the piston body). While two rows of pads are preferred, other arrangements are possible which also prevent canting of the piston 24.

It will be observed from the foregoing that the piston is easily installed in the tank, self-cleaning, and improved in performance, and that the seal resists wear.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In an elongate tank for transport or for storage in bulk of semisolid and fluid material, said tank having an outlet at one end thereof for discharging material contained therein, said tank having a generally cylindric interior surface, a generally cylindric piston sized to slide in the tank and adapted to be moved in a direction toward said outlet thereby to force the material in the tank through the outlet, said piston comprising:

a piston member;

a pair of circumferential flanges around the piston member extending radially outwardly from the piston member, said flanges being axially spaced apart to define a circumferential channel;

an elastic expandable annular seal disposed at least partly within and carried by said channel, said seal having an annular base and an annular crown disposed radially outwardly of and joined to the base, said base having an inwardly facing surface engageable with the piston member and an outwardly facing surface, said crown having side surfaces and an inwardly facing surface opposing the outwardly facing surface of said base and an outwardly facing surface engageable with the interior surface of the tank, said outwardly facing surface of the crown having two sloping surface portions, said outwardly facing surface of said base and said inwardly facing surface of said crown defining an annular fluid chamber, said seal also having a fluid inlet port for introducing fluid into and removing fluid from the fluid chamber for varying the pressure within the seal between atmospheric pressure and a pressure higher than atmospheric wherein the seal expands and presses against the interior surface of the tank with the pressure such that when the piston member slides in the tank a portion of the crown is maintained in sliding engagement with the interior surface thereby to wipe the material therefrom and to seal the piston member relative to the tank, the outwardly facing surface of said crown having a circumferential ridge intermediate the side surfaces defined by the junction of said two sloping surface portions of the crown, said two sloping surface portions of the crown each being continuously concave from one of the side surfaces to said junction whereby a minimal area of contact is maintained between the crown and the interior surface of the tank; and at least one anti-canting member extending radially outwardly beyond the periphery of the piston member and spaced axially from the seal for engagement with the interior surface of the tank for holding the piston member against canting in the tank while permitting said piston member to slide freely in said tank.

2. A piston as set forth in claim 1 wherein the side surfaces of the crown are closely adjacent opposing surfaces of said circumferential flanges.

3. A piston as set forth in claim 1 wherein the outwardly facing surface of said base and the inwardly facing surface of said crown are so shaped that the inwardly facing surface of said crown is engageable with the outwardly facing surface of said base upon substantial radially inward flexing of said crown to limit axial movement of said crown relative to said base.

4. A piston as set forth in claim 3 wherein one of said inwardly facing surface of said crown and said outwardly facing surface of said base has a circumferential protrusion and the other has a circumferential recess, said circumferential protrusion being engageable with said circumferential recess upon substantial radially inward flexing of said crown.

5. A piston as set forth in claim 3 wherein the width of said base is at least approximately twice the radial distance from the inwardly facing surface of said base to said ridge.

6. A piston as set forth in claim 1 wherein said crown further includes a first region of reduced thickness therein extending circumferentially of said seal generally axially between the ridge and first side edge of said outwardly facing surface and a second region of reduced thickness therein extending circumferentially of said seal generally axially between the ridge and second side edge of said outwardly facing surface for allowing radially inward flexing of the crown when the interior surface of the tank exerts a force on the crown as the piston member slides in the tank.

7. A generally cylindric piston for use in an elongate tank for transport or for storage in bulk of semisolid and fluid material, said tank having an outlet at one end thereof for discharging material contained therein, said tank having a generally cylindric interior surface, said piston being sized to slide in the tank and adapted to be moved in a direction toward said outlet thereby to force the material in the tank through the outlet, said piston comprising:

a piston member;

a pair of circumferential flanges around the piston member extending radially outwardly from the piston member, said flanges being axially spaced apart to define a circumferential channel;

an elastic expandable annular seal disposed at least partly within and carried by said channel, said seal having an annular base and an annular crown disposed radially outwardly of and joined to the base, said base having an inwardly facing surface engageable with the piston member and an outwardly facing surface, said crown having an inwardly facing surface opposing the outwardly facing surface of said base and an outwardly facing surface engageable with the interior surface of the tank, said outwardly facing surface of said base and said inwardly facing surface of said crown defining an annular fluid chamber, said seal also having a fluid inlet port for introducing fluid into and removing fluid from the fluid chamber for varying the pressure within the seal between atmospheric pressure and a pressure higher than atmospheric wherein the seal expands and presses against the interior surface of the tank with the pressure such that when the piston member slides in the tank a portion of the crown is maintained in sliding engagement with the interior surface thereby to wipe the material therefrom and to seal the piston member relative to the tank, one of the outwardly facing surfaces of said base and the inwardly facing surface of said crown having a circumferential protrusion and the other having a circumferential recess, said circumferential protrusion being engageable with said circumferential recess upon radially inward flexing of said crown to limit axial movement of said crown relative to said base; and at least one anti-canting member extending radially outwardly beyond the periphery of the piston member and spaced axially from the seal for engagement with the interior surface of the tank for holding the piston member against canting in the tank while permitting said piston member to slide freely in said tank.

8. A piston as set forth in claim 7 wherein said crown has at least one region of reduced thickness therein extending circumferentially of said seal for allowing radially inwardly flexing of the crown when the interior surface of the tank exerts a force on the crown as the piston member slides in the tank.

9. A piston as set forth in claim 8 wherein the outwardly facing surface of said crown has first and second side edges each closely adjacent respective outer edges of the flanges.

10. A piston as set forth in claim 9 wherein the outwardly facing surface of said crown includes two sloping surface portions and a circumferential ridge intermediate the side edges defined by the junction of said surface portions.

11. A piston as set forth in claim 8 wherein the axial width of said base is at least approximately twice the radial distance from the inwardly facing surface of said base to said ridge.

12. A piston as set forth in claim 7 wherein the outwardly facing surface of said crown has first and second side edges, two sloping surface portions and a circumferential ridge intermediate the side edges defined by the junction of said surface portions.

13. A piston as set forth in claim 12 wherein said crown further includes a first region of reduced thickness therein extending circumferentially of said seal generally axially between the ridge and first side edge of said outwardly facing surface and a second region of reduced thickness therein extending circumferentially of said seal generally axially between the ridge and second side edge of said outwardly facing surface for allowing radially inward flexing of the crown when the interior surface of the tank exerts a force on the crown as the piston member slides in the tank.

14. A piston as set forth in claim 13 wherein the outwardly facing surface of said crown has a first circumferential concave region between the ridge and one side edge and a second circumferential concave region between the ridge and the other side edge, said first and second concave regions being continuously concave from the side edges to the junction at the ridge.

15. A piston as set forth in claim 7 wherein said circumferential protrusion is generally convex and said circumferential recess is generally concave.

16. In an elongate tank for transport or for storage in bulk of semisolid and fluid material, said tank having an outlet at one end thereof for discharging material contained therein, said tank having a generally cylindric interior surface, a generally cylindric piston sized to slide in the tank and adapted to be moved in a direction toward said outlet thereby to force the material in the tank through the outlet, said piston comprising:

a piston member;

a pair of circumferential flanges around the piston member extending radially outwardly from the piston member, said flanges being axially spaced apart to define a circumferential channel;

an elastic expandable annular seal disposed at least partly within and carried by said channel, said seal having an annular base and an annular crown disposed radially outwardly of and joined to the base, said base having an inwardly facing surface engageable with the piston member and an outwardly facing surface, said crown having side surfaces and an inwardly facing surface opposing the outwardly facing surface of said base and an outwardly facing surface engageable with the interior surface of the tank, said outwardly facing surface of the crown having two sloping surface portions, said outwardly facing surface of said base and said inwardly facing surface of said crown defining an annular fluid chamber, said seal also having a fluid inlet port for introducing fluid into and removing fluid from the fluid chamber for varying the pressure within the seal between atmospheric pressure and a pressure higher than atmospheric wherein the seal expands and presses against the interior surface of the tank with the pressure such that when the piston member slides in the tank a portion of the crown is maintained in sliding engagement with the interior surface thereby to wipe the material therefrom and to seal the piston member relative to the tank, the outwardly facing surface of said crown having a circumferential ridge intermediate the side surfaces defined by the junction of said two sloping surface portions of the crown, one of said inwardly facing surface of said crown and said outwardly facing surface of said base having a circumferential convex protrusion and the other having a circumferential concave recess, said convex protrusion being engageable with said concave recess upon substantial radially inward flexing of said crown to limit axial movement of said crown relative to said base; and at least one anti-canting member extending radially outwardly beyond the periphery of the piston member and spaced axially from the seal for engagement with the interior surface of the tank for holding the piston member against canting in the tank while permitting said piston member to slide freely in said tank.

* * * * *